US008188021B2

(12) United States Patent
Chu et al.

(10) Patent No.: US 8,188,021 B2
(45) Date of Patent: May 29, 2012

(54) LUBRICATING OIL COMPOSITIONS

(75) Inventors: Chin Chu, Westwood, NJ (US); Rolfe J. Hartley, Rockaway, NJ (US); Stuart Briggs, Edison, NJ (US); Jacob Emert, Brooklyn, NY (US); Jai G. Bansal, Warren, NJ (US)

(73) Assignee: Infineum International Limited (GB)

( * ) Notice: Subject to any disclaimer, the term of this patent is extended or adjusted under 35 U.S.C. 154(b) by 0 days.

(21) Appl. No.: 12/366,007

(22) Filed: Feb. 5, 2009
(Under 37 CFR 1.47)

(65) Prior Publication Data

US 2009/0291871 A1 Nov. 26, 2009

Related U.S. Application Data

(63) Continuation of application No. 11/266,789, filed on Nov. 4, 2005, now abandoned.

(51) Int. Cl.
*C10L 1/18* (2006.01)
*C10L 1/22* (2006.01)

(52) U.S. Cl. ..... 508/542; 508/475

(58) Field of Classification Search ..... 508/542, 508/118, 475
See application file for complete search history.

(56) References Cited

U.S. PATENT DOCUMENTS

| | | | | |
|---|---|---|---|---|
| 3,668,125 | A | 6/1972 | Anderson | 508/591 |
| 4,194,057 | A | 3/1980 | Brankling et al. | 585/11 |
| 6,265,358 | B1 * | 7/2001 | Luciani et al. | 508/232 |
| 2003/0096716 | A1 | 5/2003 | Locke et al. | 508/525 |

FOREIGN PATENT DOCUMENTS

| | | | |
|---|---|---|---|
| WO | WO96/17041 | A1 | 6/1996 |
| WO | WO2004/087849 | A1 | 10/2004 |

* cited by examiner

*Primary Examiner* — Walter D Griffin
*Assistant Examiner* — Francis C Campanell

(57) ABSTRACT

A lubricating oil composition formulated with a viscosity index (VI) improver composition including a combination of an ethylene α-olefin copolymer having no greater than 66 mass % of units derived from ethylene, and a linear diblock copolymer including at least one block derived primarily from a vinyl aromatic hydrocarbon monomer, and at least one block derived primarily from diene monomer.

18 Claims, No Drawings

LUBRICATING OIL COMPOSITIONS

RELATION TO PRIOR APPLICATIONS

The present application is a continuation of U.S. Ser. No. 11/266,789 filed Nov. 4, 2005 now abandoned. The contents of the foregoing applications are incorporated herein by reference as if fully set forth herein.

FIELD OF THE INVENTION

The invention is directed to lubricating oil compositions formulated with blended viscosity index improver compositions. More specifically, the present invention is directed to lubricating oil compositions comprising a major amount of a Group II or higher base oil and a viscosity index improver composition containing at least two polymeric viscosity index improvers which lubricating oil composition, provide improved soot dispersing properties than can be achieved with the use of an equivalent amount of either polymer individually, while simultaneously providing acceptable shear stability performance.

BACKGROUND OF THE INVENTION

Lubricating oil compositions for use in crankcase engine oils comprise a major amount of base oil and minor amounts of additives that improve the performance and increase the useful life of the lubricant. Crankcase lubricating oil compositions conventionally contain polymeric components that are used to improve the viscometric performance of the engine oil, i.e., to provide multigrade oils such as SAE 5W-30, 10W-30 and 10W-40. These viscosity performance enhancing material, commonly referred to as viscosity index (VI) improvers, can effectively increase the viscosity of a lubricating oil formulation at higher temperatures (typically above 100° C.) without increasing excessively the high shear rate viscosity at lower temperatures (typically −10 to −15° C.). These oil-soluble polymers are generally of higher molecular weight (>100,000 $M_n$) compared to the base oil and other components. Well known classes of polymers suitable for use as viscosity index improvers for lubricating oil compositions include ethylene α-olefin copolymers, polymethacrylates, diblock copolymers having a vinyl aromatic segment and a hydrogenated polydiene segment, and star copolymers and hydrogenated isoprene linear and star polymers.

Viscosity index improvers for lubricating oil compositions advantageously increase the viscosity of the lubricating oil composition at higher temperatures when used in relatively small amounts (have a high thickening efficiency (TE)), provide reduced lubricating oil resistance to cold engine starting (as measured by "CCS" performance) and be resistant to mechanical degradation and reduction in molecular weight in use (have a high shear stability index (SSI)). It is also preferred that the viscosity index improver to display soot-dispersing characteristics in lubricating oil compositions. Further, as viscosity index improving polymers are often provided to lubricant blenders as a concentrate in which the viscosity index improving polymer is diluted in oil, which concentrate is then blended into a greater volume of oil to provide the desired lubricant product. Therefore, it is further preferred that viscosity index improving polymers can be blended into concentrates in relatively large amounts, without causing the concentrate to have an excessively high concentrate the kinematic viscosity. Some polymers are excellent in some of the above properties, but are deficient in one or more of the others.

It would be advantageous to be able provide lubricating oil compositions that simultaneously provide high overall viscometric performance, and soot dispersancy.

PCT Publication WO 96/17041, Jun. 6, 1996, discloses certain blends of star-branched styrene-isoprene polymers and ethylene α-olefin copolymers. The publication describes the addition of a an amount of the ethylene α-olefin copolymer to the star-branched styrene-isoprene polymer as being effective to improve the dimensional stability of the star branched polymer so that the star branched polymer can be formed as a stable, solid bale.

U.S. Pat. No. 4,194,057, Mar. 18, 1980, discloses viscosity index improving compositions containing a combination of a certain class of relatively low molecular weight vinyl aromatic/conjugated diene diblock copolymers and ethylene α-olefin copolymer. The patent describes the specified class of vinyl aromatic/conjugated diene diblock copolymer as being relatively insoluble in oil and that blending with ethylene α-olefin copolymer improves solubility and allows for the formation of polymer concentrates.

PCT Publication WO 2004/087849, Oct. 14, 2004, discloses a viscosity index improver composition containing a blend of a select class of high ethylene content ethylene α-olefin copolymer, and vinyl aromatic/diene diblock copolymer, in certain proportions, which are describes as providing good low temperature performance and durability.

SUMMARY OF THE INVENTION

In accordance with a first aspect of the invention, there is provided a lubricating oil composition comprising a major amount of a Group II or higher base oil and a viscosity index (VI) improver composition comprising a first polymer that is an amorphous or semi-crystalline ethylene α-olefin copolymer comprising no greater than 66 mass % of units derived from ethylene; and a second polymer comprising a linear diblock copolymer comprising at least one block derived primarily from a vinyl aromatic hydrocarbon monomer, and at least one block derived primarily from diene monomer.

In accordance with a third aspect of the invention, there is provided a lubricating oil composition of the first aspect in which the first polymer and the second polymer are present in a mass % ratio of from about 80:20 to about 20:80.

In accordance with a third aspect of the invention, there is provided a lubricating oil composition as in the first or second aspect, further comprising a nitrogenous dispersant derived from a polyalkene having a number average molecular weight ($M_n$) of greater than about 1500, wherein the base oil of the lubricating oil composition has a saturates content of at least about 80%, and said lubricating oil composition contains less than about 0.4 mass % of sulfur, less than about 0.12 mass % phosphorus and less than about 1.2 mass % of sulfated ash.

In accordance with a fourth aspect of the invention, there is provided a method of operating an internal combustion engine, particularly a heavy duty diesel (HDD) engine, which method comprises lubricating said engine with a lubricating oil composition as in the first, second or third aspect, and operating the lubricated engine.

In accordance with a fifth aspect of the invention, there is provided a method of improving the soot-handling properties of a lubricating oil composition for the lubrication of an internal combustion engine, particularly a heavy duty diesel (HDD) engine, which method comprises formulating the lubricating oil composition with a polymer composition comprising at least a first polymer that is an ethylene α-olefin copolymer comprising no greater than 66 mass % of units derived from ethylene; and a second polymer comprising a linear diblock copolymer comprising at least one block derived primarily from a vinyl aromatic hydrocarbon monomer, and at least one block derived primarily from diene monomer.

In accordance with a sixth aspect of the invention, there is provided a method as in the fifth aspect, wherein said lubricating oil composition is further formulated with a nitrogenous dispersant derived from a polyalkene having a number average molecular weight ($M_n$) of greater than about 1500, and a base oil of lubricating viscosity having a saturates content of at least about 80%, and wherein said lubricating oil composition contains less than about 0.4 mass % of sulfur, less than about 0.12 mass % phosphorus and less than about 1.2 mass % of sulfated ash.

In accordance with a seventh aspect of the invention, there is provided a use of a polymer composition comprising at least a first polymer that is an ethylene α-olefin copolymer comprising no greater than 66 mass % of units derived from ethylene; and a second polymer comprising a linear diblock copolymer comprising at least one block derived primarily from a vinyl aromatic hydrocarbon monomer, and at least one block derived primarily from diene monomer to improve the soot handling characteristics of a lubricating oil composition for the lubrication of an internal combustion engine, particularly a heavy duty diesel (HDD) engine.

Other and further objects, advantages and features of the present invention will be understood by reference to the following specification.

DETAILED DESCRIPTION OF THE INVENTION

Ethylene-α-olefin copolymers (OCP) useful in the practice of the invention include amorphous or semi-crystalline OCP synthesized from ethylene monomer and at least one other α-olefin comonomer. The average mass % of the OCP derived from ethylene (hereinafter "ethylene content") of OCP useful in the present invention can be as low as about 20 mass %, preferably no lower than about 25 mass %; more preferably no lower than about 30 mass %. The maximum ethylene content can be about 66 mass %. Preferably the ethylene content of the OCP is from about 25 to 55 mass %, more preferably from about 35 to 55 mass %. Crystalline ethylene-α-olefin copolymers excluded from the compositions of the present invention are defined as those comprising greater than about 60 mass ethylene (e.g. from greater than 66 to about 90 mass % ethylene).

Ethylene content can be measured by ASTM-D3900 for ethylene-propylene copolymers containing between 35 mass % and 85 mass % ethylene. Above 85 mass %, ASTM-D2238 can be used to obtain methyl group concentration, which is related to percent ethylene in an unambiguous manner for ethylene-propylene copolymers. When comonomers other than propylene are employed, no ASTM tests covering a wide range of ethylene contents are available; however, proton and carbon-13 nuclear magnetic resonance spectroscopy can be employed to determine the composition of such polymers. These are absolute techniques requiring no calibration when operated such that all nuclei of a given element contribute equally to the spectra. For ethylene content ranges not covered by the ASTM tests for ethylene-propylene copolymers, as well as for any ethylene-propylene copolymers, the aforementioned nuclear magnetic resonance methods can also be used.

"Crystallinity" in ethylene-alpha-olefin polymers can be measured using X-ray techniques known in the art as well as by the use of a differential scanning calorimetry (DSC) test. DSC can be used to measure crystallinity as follows: a polymer sample is annealed at room temperature (e.g., 20-25° C.) for at least 24 hours before the measurement. Thereafter, the sample is first cooled to −100° C. from room temperature, and then heated to 150 C at 10° C./min. Crystallinity is calculated as follows:

$$\%\ \text{Crystallinity} = \left(\sum \Delta H\right) \times x_{methylene} \times \frac{14}{4110} \times 100\%;$$

wherein ΣΔH (J/g) is the sum of the heat absorbed by the polymer above its glass transition temperature, $x_{methylene}$ is the molar fraction of ethylene in the polymer calculated, e.g., from proton NMR data, 14 (g/mol) is the molar mass of a methylene unit, and 4110 (J/mol) is the heat of fusion for a single crystal of polyethylene at equilibrium.

As noted, the ethylene-α-olefin copolymers are comprised of ethylene and at least one other α-olefin. The "other" α-olefins typically include those containing 3 to 18 carbon atoms, e.g., propylene, butene-1, pentene-1, etc. Preferred are α-olefins having 3 to 6 carbon atoms, particularly for economic reasons. The most preferred OCP are those comprised of ethylene and propylene.

As is well known to those skilled in the art, copolymers of ethylene and higher alpha-olefins such as propylene can optionally include other polymerizable monomers. Typical of these other monomers are non-conjugated dienes such as the following non-limiting examples:

a. straight chain acyclic dienes such as: 1,4-hexadiene; 1,6-octadiene;
b. branched chain acyclic dienes such as: 5-methyl-1,4-hexadiene; 3,7-dimethyl-1,6-octadiene; 3,7-dimethyl-1,7-octadiene and the mixed isomers of dihydro-mycene and dihydroocinene;
c. single ring alicyclic dienes such as: 1,4-cyclohexadiene; 1,5-cyclooctadiene; and 1,5-cyclododecadiene; and
d. multi-ring alicyclic fused and bridged ring dienes such as: tetrahydroindene; methyltetrahydroindene; dicyclopentadiene; bicyclo-(2,2,1)-hepta-2,5-diene; alkenyl, alkylidene, cycloalkenyl and cycloalkylidene norbornenes such as 5-methylene-2-norbornene (MNB), 5-ethylidene-2-norbornene (ENB), 5-propylene-2-norbornene, 5-isopropylidene-2-norbornene, 5-(4-cyclopentenyl)-2-norbornene; 5-cyclohexylidene-2-norbornene.

Of the non-conjugated dienes typically used to prepare these copolymers, dienes containing at least one of the double bonds in a strained ring are preferred. The most preferred diene is 5-ethylidene-2-norbornene (ENB). When present, the amount of diene (on a weight basis) in the copolymer can be from greater than 0% to about 20%; preferably from greater than 0% to about 15%; most preferably greater than 0% to about 10%.

The molecular weight of OCP useful in accordance with the present invention can vary over a wide range since ethylene copolymers having number-average molecular weights ($M_n$) as low as about 2,000 can affect the viscosity properties of an oleaginous composition. The preferred minimum $M_n$ is about 10,000; the most preferred minimum is about 20,000. The maximum $M_n$ can be as high as about 12,000,000; the preferred maximum is about 1,000,000; the most preferred maximum is about 750,000. An especially preferred range of number-average molecular weight for OCP useful in the present invention is from about 15,000 to about 500,000; preferably from about 20,000 to about 250,000; more preferably from about 25,000 to about 150,000. The term "number average molecular weight", as used herein, refers to the number average weight as measured by Gel Permeation Chromatography ("GPC") with a polystyrene standard.

"Thickening Efficiency" ("TE") is representative of a polymers ability to thicken oil per unit mass and is defined as:

$$TE = \frac{2}{c\ln 2}\ln\left(\frac{kv_{oil+polymer}}{kv_{oil}}\right);$$

wherein c is polymer concentration (grams of polymer/100 grams solution), $kv_{oil+polymer}$ is kinematic viscosity of the polymer in the reference oil, and $kv_{oil}$ is kinematic viscosity of the reference oil.

"Shear Stability Index" ("SSI") measures the ability of polymers used as V.I. improvers in crankcase lubricants to maintain thickening power during SSI is indicative of the resistance of a polymer to degradation under service conditions. The higher the SSI, the less stable the polymer, i.e., the more susceptible it is to degradation. SSI is defined as the percentage of polymer-derived viscosity loss and is calculated as follows:

$$SSI = 100 \times \frac{kv_{fresh} - kv_{after}}{kv_{fresh} - kv_{oil}};$$

wherein $kv_{fresh}$ is the kinematic viscosity of the polymer-containing solution before degradation and $kv_{after}$ is the kinematic viscosity of the polymer-containing solution after degradation. SSI is conventionally determined using ASTM D6278-98 (known as the Kurt-Orban (KO) or DIN bench test). The polymer under test is dissolved in suitable base oil (for example, solvent extracted 150 neutral) to a relative viscosity of 9 to 15 centistokes at 100° C. and the resulting fluid is pumped through the testing apparatus specified in the ASTM D6278-98 protocol.

"Cold Cranking Simulator" ("CCS") is a measure of the cold-cranking characteristics of crankcase lubricants and is conventionally determined using a technique described in ASTM D5293-92.

The OCP of the present invention preferably has an SSI (30 cycles) of from about 10 to about 60%, preferably from about 20 to about 50%, more preferably from about 15 to about 35%.

Linear block copolymers useful in the practice of the present invention comprise at least one block derived primarily from vinyl aromatic hydrocarbon monomer, and at least one block derived primarily from diene monomer. Useful vinyl aromatic hydrocarbon monomers include those containing from 8 to about 16 carbon atoms such as aryl-substituted styrenes, alkoxy-substituted styrenes, vinyl naphthalene, alkyl-substituted vinyl naphthalenes and the like. Dienes, or diolefins, contain two double bonds, commonly located in conjugation in a 1,3 relationship. Olefins containing more than two double bonds, sometimes referred to as polyenes, are also considered within the definition of "diene" as used herein. Useful dienes include those containing from 4 to about 12 carbon atoms, preferably from 8 to about 16 carbon atoms, such as 1,3-butadiene, isoprene, piperylene, methylpentadiene, phenylbutadiene, 3,4-dimethyl-1,3-hexadiene, 4,5-diethyl-1,3-octadiene, with 1,3-butadiene and isoprene being preferred.

Linear block copolymers useful in the practice of the present invention may be represented by the following general formula:

$$A_z\text{-}(B\text{-}A)_y\text{-}B_x$$

wherein:

A is a polymeric block derived predominantly vinyl aromatic hydrocarbon monomer;

B is a polymeric block derived predominantly conjugated diene monomer;

x and z are, independently, a number equal to 0 or 1; and y is a whole number ranging from 1 to about 15.

Useful tapered linear block copolymers may be represented by the following general formula:

A-A/B—B wherein:

A is a polymeric block derived predominantly from vinyl aromatic hydrocarbon monomer;

B is a polymeric block derived predominantly conjugated diolefin monomer; and

A/B is a tapered segment derived from both vinyl aromatic hydrocarbon monomer and conjugated diolefin monomer.

As used herein in connection with polymer block composition, "predominantly" means that the specified monomer or monomer type that is the principle component in that polymer block is present in an amount of at least 85% by weight of the block.

Polymers prepared with diolefins will contain ethylenic unsaturation, and such polymers are preferably hydrogenated. When the polymer is hydrogenated, the hydrogenation may be accomplished using any of the techniques known in the prior art. For example, the hydrogenation may be accomplished such that both ethylenic and aromatic unsaturation is converted (saturated) using methods such as those taught, for example, in U.S. Pat. Nos. 3,113,986 and 3,700,633 or the hydrogenation may be accomplished selectively such that a significant portion of the ethylenic unsaturation is converted while little or no aromatic unsaturation is converted as taught, for example, in U.S. Pat. Nos. 3,634,595; 3,670,054; 3,700,633 and Re 27,145. Any of these methods can also be used to hydrogenate polymers containing only ethylenic unsaturation and which are free of aromatic unsaturation.

The block copolymers may include mixtures of linear polymers as disclosed above, having different molecular weights and/or different vinyl aromatic contents as well as mixtures of linear block copolymers having different molecular weights and/or different vinyl aromatic contents. The use of two or more different polymers may be preferred to a single polymer depending on the rheological properties the product is intended to impart when used to produce formulated engine oil.

The block copolymer may have a number average molecular weight of between about 200,000 and about 1,500,000. A number average molecular weight of between about 350,000 and about 900,000 is preferred. The amount of vinyl aromatic content of the copolymer is preferably between about 5% and about 40% by weight of the copolymer. For such copolymers, number average molecular weights between about 85,000 and about 300,000 are acceptable.

Useful OCP and block copolymers include those prepared in bulk, suspension, solution or emulsion. As is well known, polymerization of monomers to produce hydrocarbon polymers may be accomplished using free-radical, cationic and anionic initiators or polymerization catalysts, such as transition metal catalysts used for Ziegler-Natta and metallocene type (also referred to as "single-site") catalysts.

Optionally, one or both types of VI improvers used in the practice of the invention can be provided with nitrogen-containing functional groups that impart dispersant capabilities to the VI improver. One trend in the industry has been to use such "multifunctional" VI improvers in lubricants to replace some or all of the dispersant. Nitrogen-containing functional groups can be added to a polymeric VI improver by grafting a nitrogen- or hydroxyl-containing moiety, preferably a nitrogen-containing moiety, onto the polymeric backbone of the VI improver (functionalizing). Processes for the grafting of a nitrogen-containing moiety onto a polymer are known in the art and include, for example, contacting the polymer and nitrogen-containing moiety in the presence of a free radical initiator, either neat, or in the presence of a solvent. The free radical initiator may be generated by shearing (as in an extruder) or heating a free radical initiator precursor, such as hydrogen peroxide.

The amount of nitrogen-containing grafting monomer will depend, to some extent, on the nature of the substrate polymer and the level of dispersancy required of the grafted polymer. To impart dispersancy characteristics to both star and linear copolymers, the amount of grafted nitrogen-containing monomer is suitably between about 0.4 and about 2.2 wt. %, preferably from about 0.5 to about 1.8 wt. %, most preferably from about 0.6 to about 1.2 wt. %, based on the total weight of grafted polymer.

Methods for grafting nitrogen-containing monomer onto polymer backbones, and suitable nitrogen-containing grafting monomers are known and described, for example, in U.S. Pat. No. 5,141,996, WO 98/13443, WO 99/21902, U.S. Pat. No. 4,146,489, U.S. Pat. No. 4,292,414, and U.S. Pat. No. 4,506,056. (See also *J Polymer Science*, Part A: Polymer Chemistry, Vol. 26, 1189-1198 (1988); *J. Polymer Science*, Polymer Letters, Vol. 20, 481-486 (1982) and *J. Polymer Science*, Polymer Letters, Vol. 21, 23-30 (1983), all to Gaylord and Mehta and *Degradation and Cross-linking of Ethylene-Propylene Copolymer Rubber on Reaction with Maleic Anhydride and/or Peroxides; J. Applied Polymer Science*, Vol. 33, 2549-2558 (1987) to Gaylord, Mehta and Mehta.

Both the OCP and diblock copolymer components of the present invention are available as commercial products. Infineum V534™, available from Infineum USA L.P. and Infineum UK Ltd. is an example of a commercially available amorphous OCP. Examples of commercially available styrene/hydrogenated isoprene linear diblock copolymers include Infineum SV140™, Infineum SV150™ and Infineum SV160™, available from Infineum USA L.P. and Infineum UK Ltd.; Lubrizol® 7318, available from The Lubrizol Corporation; and Septon 1001™ and Septon 1020™, available from Septon Company of America (Kuraray Group). Suitable styrene/1,3-butadiene hydrogenated block copolymers are sold under the tradename Glissoviscal™ by BASF.

Compositions of the present invention contain the specified OCP and block copolymers in a mass % ratio of from about 80:20 to about 20:80, preferably from about 35:65 to about 65:35; more preferably from about 45:55 to about 55:45. The polymer compositions of the invention can be provided in the form of a dimensionally stable, compounded solid polymer blend, or as a concentrate, containing from about 3 to about 20 mass %, preferably from about 6 to about 16 mass %, more preferably from about 9 to about 12 mass % of polymer, in oil. Alternatively, concentrates in accordance with present invention may comprise from about 0.6 to about 16.0 mass °, preferably from about 2.1 to about 10.4 mass %, more preferably from about 4.0 to about 6.6 mass % of amorphous OCP and from about 2.1 to about 10.4 mass %, preferably from about 4.0 to about 6.6 mass % of the specified linear diblock copolymer.

Such concentrates may contain the polymer blend as the only additive, or may further comprise additional additives, particularly other polymeric additives, such as lubricating oil flow improver ("LOFI"), also commonly referred to as pour point depressant ("PPD"). The LOFI or PPD is used to lower the minimum temperature at which the fluid will flow or can be poured and such additives are well known. Typical of such additives are $C_8$ to $C_{18}$ dialkyl fumarate/vinyl acetate copolymers, polymethacrylates and styrene/maleic anhydride ester copolymers. Concentrates of the present invention may contain from about 0 to about 5 mass % of LOFI. Preferably, at least about 98 mass %, more preferably at least about 99.5 mass %, of the concentrates of the present invention are VI improver, LOFI and diluent oil.

Such VI improver concentrates can be prepared by dissolving the VI improver polymer(s), and optional LOFI, in diluent oil using well known techniques. When dissolving a solid VI improver polymer to form a concentrate, the high viscosity of the polymer can cause poor diffusivity in the diluent oil. To facilitate dissolution, it is common to increase the surface are of the polymer by, for example, pelletizing, chopping, grinding or pulverizing the polymer. The temperature of the diluent oil can also be increased by heating using, for example, steam or hot oil. When the diluent temperature is greatly increased (such as to above 100° C.), heating should be conducted under a blanket of inert gas (e.g., $N_2$ or $CO_2$). The temperature of the polymer may also be raised using, for example, mechanical energy imparted to the polymer in an extruder or masticator. The polymer temperature can be raised above 150° C.; the polymer temperature is preferably raised under a blanket of inert gas. Dissolving of the polymer may also be aided by agitating the concentrate, such as by stirring or agitating (in either the reactor or in a tank), or by using a recirculation pump. Any two or more of the foregoing techniques can also be used in combination. Concentrates can also be formed by exchanging the polymerization solvent (usually a volatile hydrocarbon such as, for example, propane, hexane or cyclohexane) with oil. This exchange can be accomplished by, for example, using a distillation column to assure that substantially none of the polymerization solvent remains.

To provide a fully formulated lubricant, the solid copolymer or VI improver concentrate can be dissolved in a major amount of an oil of lubricating viscosity together with an additive package containing other necessary or desired lubricant additives. Fully formulated lubricants in accordance with the present invention may comprise from about 0.4 to about 2.5 mass %, preferably from about 0.6 to about 1.7 mass %, more preferably from about 0.8 to about 1.2 mass % of the polymer composition of the present invention, in oil. Alternatively, fully formulated lubricants in accordance with the present invention may comprise from about 0.1 to about 2.0 mass %, preferably from about 0.2 to about 1.1 mass %, more preferably from about 0.4 to about 0.7 mass % of OCP and from about 0.1 to about 2.0 mass %, preferably from about 0.2 to about 1.1 mass % of the specified linear diblock copolymer.

In one preferred embodiment, the polymer composition of the present invention comprises an amorphous OCP having an SSI value of from about 20% to about 50% (30 cycles), and the polydiene block of the diblock copolymer is derived from about 40 mass % to about 90 mass % isoprene, and from about 10 mass % to about 60 mass % butadiene units. In another preferred embodiment, the polymer composition of the present invention comprises an amorphous OCP having an SSI value of from about 20% to about 50% (30 cycles) and the polydiene block of the diblock copolymer is derived from amorphous butadiene units.

Oils of lubricating viscosity that are useful in the practice of the present invention may be selected from natural oils, synthetic oils and mixtures thereof.

Natural oils include animal oils and vegetable oils (e.g., castor oil, lard oil); liquid petroleum oils and hydro-refined, solvent-treated or acid-treated mineral oils of the paraffinic, naphthenic and mixed paraffinic-naphthenic types. Oils of lubricating viscosity derived from coal or shale also serve as useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkylbenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulfides and derivative, analogs and homologs thereof.

Alkylene oxide polymers and interpolymers and derivatives thereof where the terminal hydroxyl groups have been modified by esterification, etherification, etc., constitute another class of known synthetic oils. These are exemplified by polyoxyalkylene polymers prepared by polymerization of ethylene oxide or propylene oxide, and the alkyl and aryl ethers of polyoxyalkylene polymers (e.g., methyl-polyisopropylene glycol ether having a molecular weight of 1000 or diphenyl ether of poly-ethylene glycol having a molecular weight of 1000 to 1500); and mono- and polycarboxylic esters thereof, for example, the acetic acid esters, mixed $C_3$-$C_8$ fatty acid esters and $C_{13}$ Oxo acid diester of tetraethylene glycol.

Another suitable class of synthetic oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Examples of such esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol esters such as neopentyl glycol, trimethylolpropane, pentaerythritol, dipentaerythritol and tripentaerythritol.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl) silicate, tetra-(4-methyl-2-ethylhexyl)silicate, tetra-(p-tert-butyl-phenyl) silicate, hexa-(4-methyl-2-ethylhexyl)disiloxane, poly(methyl)siloxanes and poly(methylphenyl) siloxanes. Other synthetic lubricating oils include liquid esters of phosphorous-containing acids (e.g., tricresyl phosphate, trioctyl phosphate, diethyl ester of decylphosphonic acid) and polymeric tetrahydrofurans.

The oil of lubricating viscosity useful in the practice of the present invention may comprise a Group II, Group III, Group IV or Group V oil or blends of the aforementioned oils. The oil of lubricating viscosity may also comprise a blend of Group I oil and one or more of a Group II, Group III, Group IV or Group V oil, containing up to about 30 mass %, preferably no greater than 15 mass %, more preferably no greater than 10 mass %, of Group I oil. Definitions for the oils as used herein are the same as those found in the American Petroleum Institute (API) publication "Engine Oil Licensing and Certification System", Industry Services Department, Fourteenth Edition, December 1996, Addendum 1, December 1998. Said publication categorizes oils as follows:

a) Group I oils contain less than 90 percent saturates and/or greater than 0.03 percent sulfur and have a viscosity index greater than or equal to 80 and less than 120 using the test methods specified in Table 1.
b) Group II oils contain greater than or equal to 90 percent saturates and less than or equal to 0.03 percent sulfur and have a viscosity index greater than or equal to 80 and less than 120 using the test methods specified in Table 1. Although not a separate Group recognized by the API, Group II oils having a viscosity index greater than about 110 are often referred to as "Group II+" oils.
c) Group III oils contain greater than or equal to 90 percent saturates and less than or equal to 0.03 percent sulfur and have a viscosity index greater than or equal to 120 using the test methods specified in Table 1.
d) Group IV oils are polyalphaolefins (PAO).
e) Group V oils are all other base stocks not included in Group I, II, III, or IV.

| Property | Test Method |
|---|---|
| Saturates | ASTM D2007 |
| Viscosity Index | ASTM D2270 |
| Sulfur | ASTM D4294 |

Preferably the volatility of the oil of lubricating viscosity, as measured by the Noack test (ASTM D5880), is less than or equal to about 40%, such as less than or equal to about 35%, preferably less than or equal to about 32%, such as less than or equal to about 28%, more preferably less than or equal to about 16%. Preferably, the viscosity index (VI) of the oil of lubricating viscosity is at least 100, preferably at least 110, more preferably greater than 120.

In addition to the VI improver and LOFI, a fully formulated lubricant can generally contain a number of other performance improving additives selected from ashless dispersants, metal-containing, or ash-forming detergents, antiwear agents, oxidation inhibitors or antioxidants, friction modifiers and fuel economy agents, and stabilizers or emulsifiers. Conventionally, when formulating a lubricant, the VI improver and/or VI improver and LOFI, will be provided to the formulator in one concentrated package, and combinations of the remaining additives will provided in one or more additional concentrated packages, oftentimes referred to as DI (dispersant-inhibitor) packages.

Dispersants useful in the context of the present invention include the range of nitrogen-containing, ashless (metal-free) dispersants known to be effective to reduce formation of deposits upon use in gasoline and diesel engines, when added to lubricating oils. The ashless, dispersants of the present invention comprise an oil soluble polymeric long chain backbone having functional groups capable of associating with particles to be dispersed. Typically, such dispersants have amine, amine-alcohol or amide polar moieties attached to the polymer backbone, often via a bridging group. The ashless dispersant may be, for example, selected from oil soluble salts, esters, amino-esters, amides, imides and oxazolines of long chain hydrocarbon-substituted mono- and polycarboxylic acids or anhydrides thereof; thiocarboxylate derivatives of long chain hydrocarbons; long chain aliphatic hydrocarbons having polyamine moieties attached directly thereto; and Mannich condensation products formed by condensing a long chain substituted phenol with formaldehyde and polyalkylene polyamine.

Preferred dispersant compositions for use with the VI improving copolymers of the present invention are nitrogen-containing dispersants derived from polyalkenyl-substituted mono- or dicarboxylic acid, anhydride or ester, which dispersant has a polyalkenyl moiety with a number average molecular weight of from about 1500 to 3000, preferably from about 1800 to 2500. Further preferable, are succinimide dispersants derived from polyalkenyl moieties with a number average molecular weight of from about 1800 to 2500 and from about 1.2 to about 1.7, preferably from greater than about 1.3 to about 1.6, most preferably from greater than about 1.3 to about 1.5 functional groups (mono- or dicarboxylic acid producing moieties) per polyalkenyl moiety (a medium functionality dispersant). Functionality (F) can be determined according to the following formula:

$$F=(\mathrm{SAP}\times M_n)/((112{,}200\times A.I.)-(\mathrm{SAP}\times 98))$$

wherein SAP is the saponification number (i.e., the number of milligrams of KOH consumed in the complete neutralization of the acid groups in one gram of the succinic-containing reaction product, as determined according to ASTM D94); $M_n$ is the number average molecular weight of the starting olefin polymer; and A.I. is the percent active ingredient of the succinic-containing reaction product (the remainder being unreacted olefin polymer, succinic anhydride and diluent).

Generally, each mono- or dicarboxylic acid-producing moiety will react with a nucleophilic group (amine, alcohol, amide or ester polar moieties) and the number of functional groups in the polyalkenyl-substituted carboxylic acylating agent will determine the number of nucleophilic groups in the finished dispersant.

A preferred dispersant composition is one comprising at least one polyalkenyl succinimide, which is the reaction product of a polyalkenyl substituted succinic anhydride (e.g., PIBSA) and a polyamine (PAM) that has a coupling ratio of from about 0.65 to about 1.25, preferably from about 0.8 to about 1.1, most preferably from about 0.9 to about 1. In the context of this disclosure, "coupling ratio" may be defined as a ratio of succinyl groups in the PIBSA to primary amine groups in the polyamine reactant.

The dispersant(s) are preferably non-polymeric (e.g., are mono- or bis-succinimides). The dispersant(s) of the present invention can be borated by conventional means, as generally taught in U.S. Pat. Nos. 3,087,936, 3,254,025 and 5,430,105. Boration of the dispersant is readily accomplished by treating an acyl nitrogen-containing dispersant with a boron compound such as boron oxide, boron halide boron acids, and esters of boron acids.

The dispersant or dispersants can be present in an amount sufficient to contribute at least 0.08 wt. % of nitrogen, preferably from about 0.10 to about 0.18 wt. %, more preferably from about 0.115 to about 0.16 wt. %, and most preferably from about 0.12 to about 0.14 wt. % of nitrogen to the lubricating oil composition.

Additional additives that may be incorporated into the compositions of the invention to enable particular performance requirements to be met are detergents, metal rust inhibitors, corrosion inhibitors, oxidation inhibitors, friction modifiers, anti-foaming agents, anti-wear agents and pour point depressants. Some are discussed in further detail below.

Metal-containing or ash-forming detergents function both as detergents to reduce or remove deposits and as acid neutralizers or rust inhibitors, thereby reducing wear and corrosion and extending engine life. Detergents generally comprise a polar head with a long hydrophobic tail, with the polar head comprising a metal salt of an acidic organic compound. The salts may contain a substantially stoichiometric amount of the metal in which case they are usually described as normal or neutral salts, and would typically have a total base number or TBN (as can be measured by ASTM D2896) of from 0 to 80. A large amount of a metal base may be incorporated by reacting excess metal compound (e.g., an oxide or hydroxide) with an acidic gas (e.g., carbon dioxide). The resulting overbased detergent comprises neutralized detergent as the outer layer of a metal base (e.g. carbonate) micelle. Such overbased detergents may have a TBN of 150 or greater, and typically will have a TBN of from 250 to 450 or more.

In a non-limiting embodiment of the invention, the metal-containing detergent comprises less than 50 mole %, for example, less than 40 mole % or less than 30 mole % or less than 20 mole % or less than 10 mole % or less than 5 mole %, of a metal salt of an aromatic carboxylic acid, based on the moles of the metal salts of organic acids in the detergent composition. A description of this metal-containing detergent is contained in US Publication No. 20030096716 which is hereby incorporated by reference.

The detergent can be present in the lubricating oil composition in an amount, based on surfactant content, of less than 5, for example, less than 2 or less than 1 millimoles of surfactant per kilogram of the lubricating oil composition (mmol/kg).

In another non-limiting embodiment of the invention, the metal-containing detergent described above is excluded from the composition entirely.

Dihydrocarbyl dithiophosphate metal salts are frequently used as antiwear and antioxidant agents. The metal may be an alkali or alkaline earth metal, or aluminum, lead, tin, molybdenum, manganese, nickel or copper. The zinc salts are most commonly used in lubricating oil and may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound could be used but the oxides, hydroxides and carbonates are most generally employed. Commercial additives frequently contain an excess of zinc due to the use of an excess of the basic zinc compound in the neutralization reaction.

Oxidation inhibitors or antioxidants reduce the tendency of mineral oils to deteriorate in service. Oxidative deterioration can be evidenced by sludge in the lubricant, varnish-like deposits on the metal surfaces, and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, oil soluble phenates and sulfurized phenates, phosphosulfurized or sulfurized hydrocarbons, phosphorous esters, metal thiocarbamates, oil soluble copper compounds as described in U.S. Pat. No. 4,867,890, and molybdenum-containing compounds and aromatic amines.

Known friction modifiers include oil-soluble organo-molybdenum compounds. Such organo-molybdenum friction modifiers also provide antioxidant and antiwear credits to a lubricating oil composition. As an example of such oil soluble organo-molybdenum compounds, there may be mentioned the dithiocarbamates, dithiophosphates, dithiophosphinates, xanthates, thioxanthates, sulfides, and the like, and mixtures thereof. Particularly preferred are molybdenum dithiocarbamates, dialkyldithiophosphates, alkyl xanthates and alkylthioxanthates.

Other known friction modifying materials include glyceryl monoesters of higher fatty acids, for example, glyceryl monooleate; esters of long chain polycarboxylic acids with diols, for example, the butane diol ester of a dimerized unsaturated fatty acid; oxazoline compounds; and alkoxylated alkyl-substituted mono-amines, diamines and alkyl ether amines, for example, ethoxylated tallow amine and ethoxylated tallow ether amine.

Foam control can be provided by an antifoamant of the polysiloxane type, for example, silicone oil or polydimethyl siloxane.

Some of the above-mentioned additives can provide a multiplicity of effects; thus for example, a single additive may act as a dispersant-oxidation inhibitor. This approach is well known and need not be further elaborated herein.

It may also be necessary to include an additive which maintains the stability of the viscosity of the blend. Thus, although polar group-containing additives achieve a suitably low viscosity in the pre-blending stage it has been observed that some compositions increase in viscosity when stored for prolonged periods. Additives which are effective in controlling this viscosity increase include the long chain hydrocarbons functionalized by reaction with mono- or dicarboxylic acids or anhydrides which are used in the preparation of the ashless dispersants as hereinbefore disclosed.

Representative effective amounts of such additional additives, when used in crankcase lubricants, are listed below:

| ADDITIVE | Mass % (Broad) | Mass % (Preferred) |
|---|---|---|
| Ashless Dispersant | 0.1-20 | 1-8 |
| Metal Detergents | 0.1-15 | 0.2-9 |
| Corrosion Inhibitor | 0-5 | 0-1.5 |
| Metal Dihydrocarbyl Dithiophosphate | 0.1-6 | 0.1-4 |
| Antioxidant | 0-5 | 0.01-2 |
| Pour Point Depressant | 0.01-5 | 0.01-1.5 |
| Antifoaming Agent | 0-5 | 0.001-0.15 |
| Supplemental Antiwear Agents | 0-1.0 | 0-0.5 |
| Friction Modifier | 0-5 | 0-1.5 |
| Basestock | Balance | Balance |

Fully formulated passenger car diesel engine lubricating oil (PCDO) compositions of the present invention preferably have a sulfur content of less than about 0.4 mass %, such as less than about 0.35 mass %, more preferably less than about 0.03 mass %, such as less than about 0.15 mass %. Preferably, the Noack volatility of the fully formulated PCDO (oil of lubricating viscosity plus all additives) will be no greater than 13, such as no greater than 12, preferably no greater than 10. Fully formulated PCDOs of the present invention preferably have no greater than 1200 ppm of phosphorus, such as no greater than 1000 ppm of phosphorus, or no greater than 800 ppm of phosphorus. Fully formulated PCDOs of the present invention preferably have a sulfated ash (SASH) content of about 1.0 mass % or less.

Fully formulated heavy duty diesel engine (HDD) lubricating oil compositions of the present invention preferably have a sulfur content of less than about 1.0 mass %, such as less than about 0.6 mass % more preferably less than about 0.4 mass %, such as less than about 0.15 mass %. Preferably, the Noack volatility of the fully formulated HDD lubricating oil composition (oil of lubricating viscosity plus all additives) will be no greater than 20, such as no greater than 15, preferably no greater than 12. Fully formulated HDD lubricating oil compositions of the present invention preferably have no greater than 1600 ppm of phosphorus, such as no greater than 1400 ppm of phosphorus, or no greater than 1200 ppm of phosphorus. Fully formulated HDD lubricating oil compositions of the present invention preferably have a sulfated ash (SASH) content of about 1.0 mass % or less.

This invention will be further understood by reference to the following examples. All weight percents expressed herein (unless otherwise indicated) are based on active ingredient (AI) content of the additive, and/or upon the total weight of any additive-package, or formulation which will be the sum of the AI weight of each additive plus the weight of total oil and/or diluent.

EXAMPLES

Example 1

Using a Group II base oil and a commercial additive package (DI package) containing dispersant, detergent antioxidant, antiwear agent (ZDDP), and antifoamant, an the VI improvers identified below, a series of lubricants were blended to meet the J-300 viscosity requirements for the 15W-40 viscosity grade. All the oils were formulated as shown to have the same kinematic viscosity at 100° C. ($kv_{100}$). In the following Table 1, all numbers represent mass % relative to the total mass of the exemplified compositions. VII-1 is a commercially available isoprene/styrene diblock copolymer having a styrene content of 35 mass %, and a number average molecular weight (Mn) of 130,000 (6.00 mass % A.I.).

VII-2 is a commercially available amorphous OCP having an ethylene-derived content of 49 mass % and a number average molecular weight (Mn) of 59,500 (9.50 mass % A.I.).

VII-3 is a commercially available semicrystalline OCP having an ethylene-derived content of 59.9 mass % and a number average molecular weight (Mn) of 86,700 (7.65 mass % A.I.).

TABLE 1

| | Example | | | | |
|---|---|---|---|---|---|
| Component | Comp. 1 | Comp. 2 | Comp. 3 | Comp. 4 | Inv. 1 |
| Group II Oil | 72.1 | 72.1 | 72.1 | 72.1 | 72.1 |
| DI Package | 14.7 | 14.7 | 14.7 | 14.7 | 14.7 |
| LOFI | 0.2 | 0.2 | 0.2 | 0.2 | 0.2 |
| VII-1 | 13.0 | — | — | 8.5 | 8.7 |
| VII-2 | — | — | 13.0 | — | 4.2 |
| VII-3 | — | 13.0 | — | 4.5 | — |

The soot-dispersing performance of the exemplified formulations was determined in a carbon black bench test (CBBT). In the CBBT, the ability of a finished oil sample to disperse carbon black is evaluated by mixing the finished oil samples with increasing amounts of carbon black, stirring the samples overnight at 90° C., and evaluating the samples for viscosity and index using a rotational viscometer. The shear rate of the rotational viscometer is varied up to 300 $sec^{-1}$ and a plot of shear vs. log viscosity is obtained. If the viscosity is Newtonian, the slope of the plot (index) approaches unity, indicating that the soot remains well dispersed. If the index becomes significantly less than unity, there is shear thinning, which is indicative of poor soot dispersancy. The results achieved with the exemplified samples are tabulated below, in Table 2a and Table 2b.

TABLE 2a

| | $k_{v100}$ | | | | |
|---|---|---|---|---|---|
| | Example | | | | |
| CB (%) | Comp. 1 | Comp. 2 | Comp. 3 | Comp. 4 | Inv. 1 |
| 6 | 29.17 | 27.95 | 46.10 | 30.52 | 30.10 |
| 8 | 48.55 | 43.09 | 49.57 | 65.80 | 36.58 |
| 12 | 475.11 | 283.88 | 189.64 | 908.42 | 98.42 |

TABLE 2b

| | Index | | | | |
|---|---|---|---|---|---|
| | Example | | | | |
| CB (%) | Comp. 1 | Comp. 2 | Comp. 3 | Comp. 4 | Inv. 1 |
| 6 | 0.937 | 0.973 | 0.514 | 0.907 | 0.924 |
| 8 | 0.773 | 0.884 | 0.718 | 0.617 | 0.971 |
| 12 | 0.072 | 0.188 | 0.321 | 0.123 | 0.724 |

The soot-dispersing properties of isoprene/styrene diblock copolymers are known and confirmed by the excellent results achieved with Comp. 1. Surprisingly, soot dispersing performance of the material containing a blend of the isoprene/styrene diblock copolymer with the crystalline OCP, is far worse than the material containing the crystalline OCP alone (compare results with Comp. 4 with those of Comp. 2). In contrast, the use of a blend of the isoprene/styrene diblock copolymer with the amorphous OCP results in improved soot dispersancy compared to each of the isoprene/styrene diblock copolymer and amorphous OCP alone (compare results with Inv. 1 with those of Comp. 1 and Comp. 3).

Table 3, below, indicates the polymer content and properties of the above-samples are shown below, in Table 3.

TABLE 3

| | Comp. 1 | Comp. 2 | Comp. 3 | Comp. 4 | Inv. 1 |
|---|---|---|---|---|---|
| Solid Polymer % | 0.78 | 0.52 | 0.64 | 0.69 | 0.75 |
| Kv100 (cSt) | 14.43 | 14.42 | 14.59 | 14.65 | 14.71 |
| CCS @ −30° C. (cP) | 5428 | 5248 | 5814 | 5495 | 5700 |
| MRV @ −30° C. (cP) | 16737 | 14158 | 18314 | 16240 | 18321 |
| MRV @ −30° C. (YS) | <35 | <35 | <35 | <35 | <35 |
| 30 cycle KO shear | | | | | |
| $kv_{100}$ (cSt) | 13.8 | 12.53 | 12.65 | 13.36 | 13.49 |
| $\Delta kv_{100}$ | 0.63 | 1.89 | 1.94 | 1.29 | 1.22 |

As is shown, while the blend of the isoprene/styrene diblock copolymer and the amorphous OCP requires less polymer to meet the target $k_{v100}$ relative to the use of the isoprene/styrene diblock copolymer alone, and therefore has an improved thickening efficiency, the thickening efficiency of a blend of crystalline OCP and isoprene/styrene diblock copolymer is inferior to that of the crystalline OCP, alone. Further, the blends of the present invention are shown to provide acceptable SSI (see ΔKv100).

The disclosures of all patents, articles and other materials described herein are hereby incorporated, in their entirety, into this specification by reference. A description of a composition comprising, consisting of, or consisting essentially of multiple specified components, as presented herein and in the appended claims, should be construed to also encompass compositions made by admixing said multiple specified components. The principles, preferred embodiments and modes of operation of the present invention have been described in the foregoing specification. What applicants submit is their invention, however, is not to be construed as limited to the particular embodiments disclosed, since the disclosed embodiments are regarded as illustrative rather than limiting. Changes may be made by those skilled in the art without departing from the spirit of the invention.

What is claimed is:

1. A lubricating oil composition comprising a major amount of an oil of a Group II or higher base oil of lubricating viscosity and a minor amount of a polymer composition comprising 0.1 to 2.0 mass % of at least a first polymer that is an ethylene α-olefin copolymer comprising no greater than 55 mass % of units derived from ethylene; and 0.1 to 2.0 mass % of a second polymer comprising a linear diblock copolymer having an average molecular weight ranging from 200,000 to 1,500,000 comprising at least one block derived primarily from a vinyl aromatic hydrocarbon monomer, and at least one block derived primarily from diene monomer wherein the lubricating oil composition exhibits superior soot dispersing performance.

2. A lubricating oil composition as claimed in claim 1, wherein the first polymer and the second polymer are present in a mass % ratio of from about 80:20 to about 20:80.

3. A lubricating oil composition as claimed in claim 2, wherein said ethylene α-olefin copolymer is an ethylene-propylene copolymer and said linear diblock copolymer is at least one diblock copolymer comprising at least one polystyrene block, and at least one block derived from isoprene, butadiene, or a mixture thereof.

4. A lubricating oil composition as claimed in claim 3, wherein said ethylene α-olefin copolymer is an ethylene-propylene copolymer and said linear diblock copolymer is at least one diblock copolymer selected from the group consisting of hydrogenated styrene/butadiene block copolymers and hydrogenated styrene/isoprene block copolymers.

5. A lubricating oil composition as claimed in claim 3, wherein said ethylene-propylene copolymer comprises from about 20 to about 55 mass % of units derived from ethylene.

6. A lubricating oil composition as claimed in claim 3, wherein said ethylene-propylene copolymer has a Shear Stability Index (SSI) value of from about 20% to about 50% (30 cycles), and the polydiene block of the diblock copolymer comprises from about 40 mass % to 90 mass % derived from isoprene and from about 10 mass % to about 60 mass % derived from butadiene.

7. A lubricating oil composition as claimed in claim 1, wherein said base oil of lubricating viscosity has a saturates content of at least about 80.

8. A lubricating oil composition as claimed in claim 1, containing less than about 30 mass % of Group I base oil.

9. A lubricating oil composition as claimed in claim 1, further comprising a nitrogenous dispersant derived from a polyalkene having a number average molecular weight ($M_n$) of greater than about 1500, wherein said base oil of lubricating viscosity has a saturates content of at least about 80%, and wherein said lubricating oil composition contains less than about 0.4 mass % of sulfur, less than about 0.12 mass % phosphorus and less than about 1.2 mass % of sulfated ash.

10. A lubricating oil composition as claimed in claim 1, further comprising a metal-containing detergent.

11. A lubricating oil composition as claimed in claim 10, wherein the metal-containing detergent comprises less than 40 mole % of a metal salt of an aromatic carboxylic acid, based on the moles of the metal salts of organic acids in the detergent composition.

12. A lubricating oil composition as claimed in claim 11, wherein the metal-containing detergent is present in the composition in an amount, based on surfactant content, less than 5 millimoles of surfactant per kilogram of the oil composition (mmol/kg).

13. A lubricating oil composition as claimed in claim 1, which contains no metal-containing detergent.

14. A method of operating an internal combustion engine, said method comprising lubricating said engine with a lubricating oil composition as claimed in claim 1, and operating the lubricating engine.

15. A method of operating an internal combustion engine, said method comprising lubricating said engine with a lubricating oil composition as claimed in claim 9, and operating the lubricating engine.

16. The method as claimed in claim 15, wherein said engine is a heavy duty diesel (HDD) engine.

17. A method of improving the soot-dispersing handling properties of a lubricating oil composition for the lubrication of an internal combustion engine, which method comprises formulating said lubricating oil composition with a polymer composition comprising 0.1 to 2.0 mass % of at least a first polymer that is an ethylene α-olefin copolymer comprising no greater than 55 mass % of units derived from ethylene; and 0.1 to 2.0 mass % of a second polymer comprising a linear diblock copolymer having an average molecular weight ranging from 200,000 to 1,500,000 comprising at least one block derived primarily from a vinyl aromatic hydrocarbon monomer, and at least one block derived primarily from diene monomer.

18. The method as claimed in claim 17, wherein said lubricating oil composition is further formulated with a nitrogenous dispersant derived from a polyalkene having a number average molecular weight ($M_n$) of greater than about 1500, and a base oil of lubricating viscosity having a saturates content of at least about 80%, and wherein said lubricating oil composition contains less than about 0.4 mass % of sulfur, less than about 0.12 mass % phosphorus and less than about 1.2 mass % of sulfated ash.

* * * * *